United States Patent [19]

Rogers, Jr.

[11] 4,272,075

[45] Jun. 9, 1981

[54] FISHING GAME

[76] Inventor: Thurmond J. Rogers, Jr., 7245 Fairbanks-N. Houston, Houston, Tex. 77040

[21] Appl. No.: 80,997

[22] Filed: Oct. 1, 1979

[51] Int. Cl.[3] ..... A63F 9/00

[52] U.S. Cl. ..... 273/1 E; 273/140

[58] Field of Search ..... 273/1 R, 1 E, 1 M, 140

[56] References Cited

U.S. PATENT DOCUMENTS

| | | | |
|---|---|---|---|
| 947,124 | 1/1910 | Renner | 273/140 UX |
| 1,594,164 | 7/1926 | Foster | 273/140 X |
| 1,663,962 | 3/1928 | Uhlig | 273/140 |
| 2,408,141 | 9/1946 | Heil | 273/140 X |
| 2,460,146 | 1/1949 | Prentice | 273/1 E |
| 2,557,789 | 6/1951 | Lamka | 273/140 |
| 3,721,440 | 3/1973 | Burns | 273/1 R |
| 3,836,142 | 9/1974 | Baker | 273/1 M |
| 4,039,184 | 8/1977 | Breslow et al. | 273/1 E |

FOREIGN PATENT DOCUMENTS

| | | | |
|---|---|---|---|
| 685361 | 3/1965 | Italy | 273/1 E |

OTHER PUBLICATIONS

Playthings Magazine, vol. No. 56, No. 8, 8-1958, p. 26, "Fishermans Luck".

*Primary Examiner*—Paul E. Shapiro

*Attorney, Agent, or Firm*—Neal J. Mosely

[57] ABSTRACT

A novel fishing game comprises a rectangular supporting structure having a plurality of target holes along one part of the upper surface thereof and having a supporting base portion with slots therein for movement of a slidable supporting member for fishing poles. The support is arranged to permit movement laterally and longitudinally in the slots to position the fishing pole over the target holes. The support permits angular movement of the fishing poles and includes a rotary spool for raising and lowering a fishing line. The fishing line carries a magnetic member which may be lowered through any of the target holes to pick up magnetized, i.e. iron or steel, fish. The fish which are the targets of the game and the expedient of scoring the same are positioned in cylindrical receptacles located under each of the target holes. The receptacles are provided with electrical conductors around their upper ends which are engageable by the magnetic member when moved into position to pick up individual fish in such receptacles. Contact of the magnetic member with the conductors at the top of each receptacle completes an electric circuit to energize a signal light for indicating progress of the game. A game is played against time and the contestant who scores the most in the selected time period wins the game.

14 Claims, 13 Drawing Figures

FISHING GAME

BACKGROUND OF THE INVENTION

1. Field of the Invention

This invention relates to new and useful improvements in fishing games.

2. Description of the Prior Art

Prior art children's fishing games have been unimaginative and contribute little or nothing to the development of eye-hand coordination and manual dexterity. Such games have usually included only a rod with a string attached to one end or have in some cases included wind up wheels or specially designed fishing poles.

Prentice U.S. Pat. No. 2,460,146 discloses a game for picking up jackstraws or the like in which an electric signal light is utilized for scoring.

Luchsinger U.S. Pat. No. 3,249,357 discloses a magnetic game of skill wherein a magnetic device simulating a diver is manipulated by hand into a target area to recover target items representing treasure while avoiding a hazard, simulating an octopus.

Baker U.S. Pat. No. 3,836,142 discloses a magnetic fishing game which includes a plurality of wells and magnets of different strength to deflect the hook or other retrieving element used in catching the target elements or fish.

Hoetzel U.S. Pat. No. 3,864,872 discloses a novel fishing pole for use in a children's fishing game and including a magnet for catching a toy fish.

Breslow U.S. Pat. No. 4,039,184 discloses a fishing or retrieval type game having adjustably moveable target receptacles.

Treasarden U.S. Pat. No. 4,103,890 discloses a timed fishing or retrieval game having electrical signals for scoring.

OBJECTS OF THE INVENTION

One of the objects of this invention is to provide a new and improved fishing game.

Another object of this invention is to provide an improved fishing game having an improved, manually moveable fishing rod adjustably moveable and operable to position retrieving means in selected openings or receptacles.

Another object of this invention is to provide an improved fishing game having improved scoring and indicating accessories.

Another object of this invention is to provide an improved fishing game having electric indicating means associated with target receptacles.

Still another object of this invention is to provide a new and improved fishing game having an improved fish rod support and tracking mechanism therefor.

Another object of this invention is to provide a new and improved fishing game which is simply constructed and easily and inexpensively assembled.

Other objects of this invention will become apparent from time to time throughout the specification and claims as hereinafter related.

SUMMARY OF THE INVENTION

The objectives listed above and other objects are achieved by the novel fishing game which comprises this invention. A novel fishing game comprises a rectangular supporting structure having a plurality of target holes along one part of the upper surface thereof and having a supporting base portion with slots therein for movement of a slidable supporting member for fishing poles. The support is arranged to permit movement laterally and longitudinally in the slots to position the fishing hole over the target holes. The support permits angular movement of the fishing poles and includes rotary means for raising and lowering a fishing line. The fishing line carries a magnetic member which may be lowered through any of the target holes to pick up magnetized, i.e. iron or steel, fish. The fish which are the targets of the game and the means of scoring the same are positioned in cylindrical receptacles located under each of the target holes. The receptacles are provided with electrical conductors around their upper ends which are engageable by the magnetic member when moved into position to pick up individual fish in such receptacles. Contact of the magnetic member with the conductors at the top of each receptacle completes an electric circuit to energize a signal light for indicating progress of the game. A game is played against time and the contestant who scores the most in the selected time period wins the game.

BRIEF DESCRIPTION OF THE DRAWINS

DESCRIPTION OF THE PREFERRED EMBODIMENT

Figure 1:
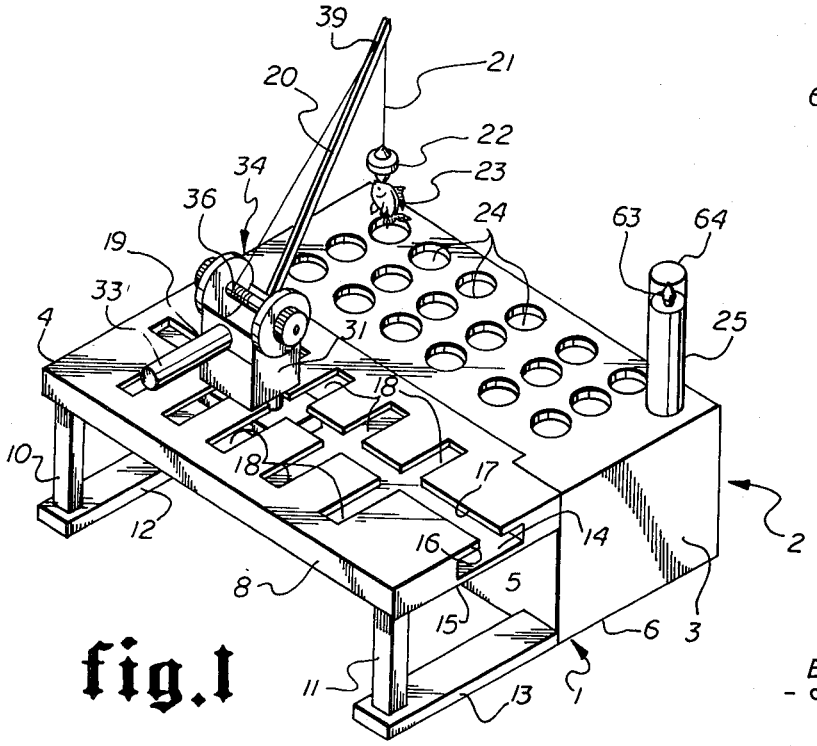
FIG. 1 is an isometric view of a preferred embodiment of a novel fishing game.
Figure 3:
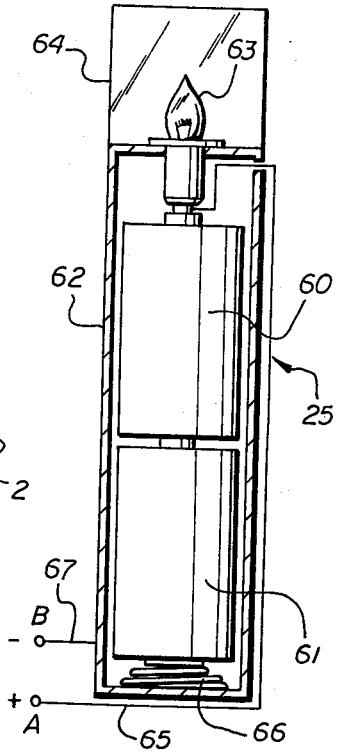
FIG. 3 is a detail view partially in elevation and partially in section illustrating the indicator light for the fishing game.

Referring to the drawings by numerals of reference, and more particularly FIG. 1, there is shown an isometric view of a fishing game 1 comprising a box like structure 2 having closed end walls 3 and 4, a closed front wall 5, bottom wall 6, and top wall 7. The rear of the box structure 2 is open as will be seen in FIG. 4. A supporting table 8 is secured on box member 2 adjacent to upper wall 7 as indicated at 9 and is supported on vertically extending legs 10 and 11 which are secured to horizontally extending legs 12 and 13 extending outward from front wall 5 of box 2.

Table 8 has a hollow internal cavity at 14 defined by a lower wall portion 15 and upper wall portion 16. Upper wall 16 has a single continuous laterally extending slot 17 and a plurality of parallel longitudinally extending slots 18 (longitudinally of the apparatus).

A mobile supporting member or Rover 19 is moveable in cavity 14 within the limitations of slots 17 and 18. Rover 19 supports fishing rod 20, fishing line 21 and magnetic retriever or "cork" 22. Cork 22 is used for magnetic retrieval of fish 23 from the apparatus. The retrieval of a maximum number of fish in a predetermined period of time, without disqualification, produces a maximum score to win the game. The top wall 7 of box 2 has a plurality of holes 24 from which the fish 23 are retrieved. A signal unit or lighthouse 25 is positioned on top wall 7 and indicates contact of cork 22 with the receptacle in which fish 23 is located to indicate recovery of the fish from a particular receptacle.

Figures 4, 5, 12, 13:
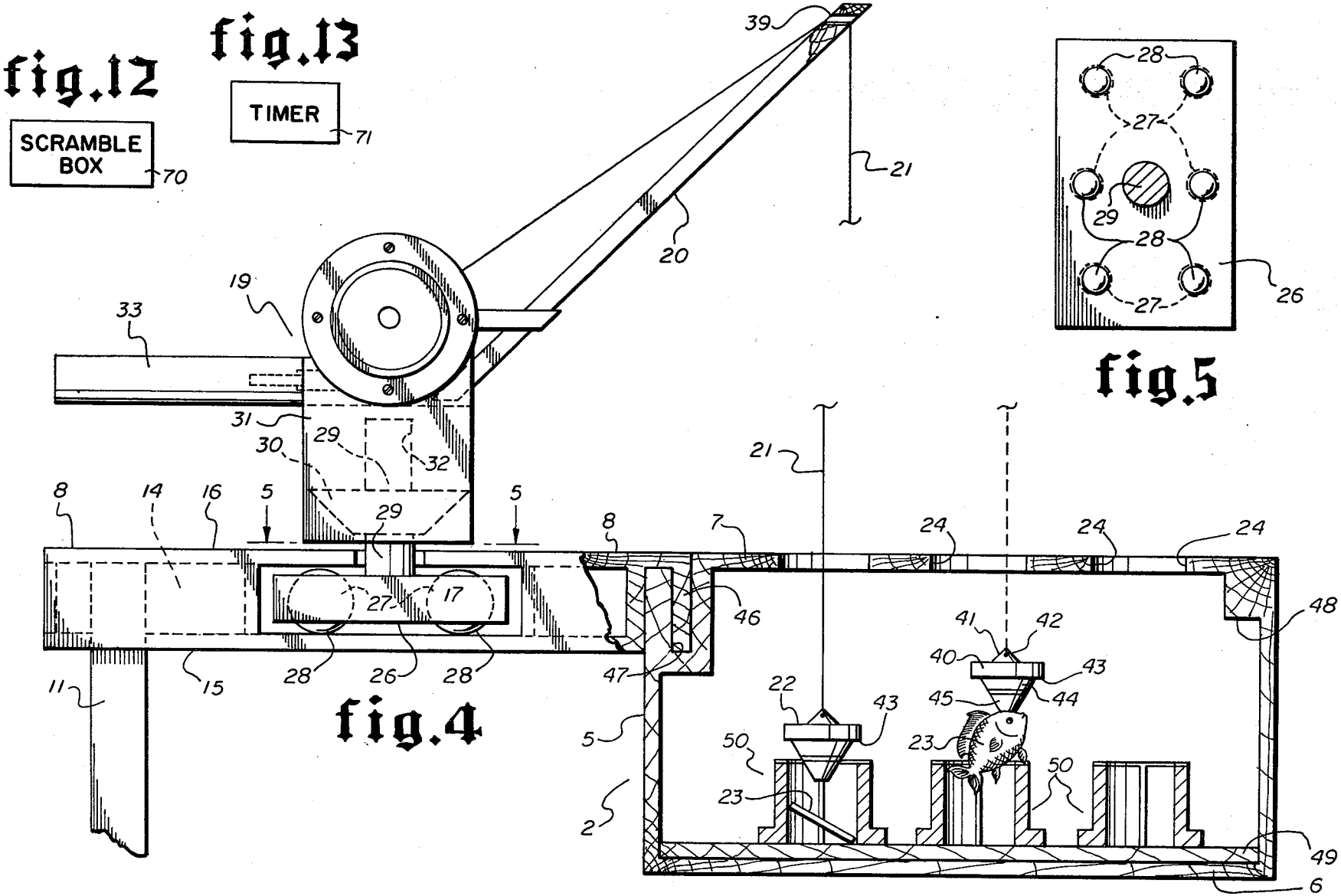
FIG. 4 is a view in side elevation and partially in section of the fishing game shown in FIG. 1.
FIG. 5 is a sectional view on the line 5—5 FIG. 4 showing the roving support member for the fishing pole assembly.
FIG. 12 is schematic view of a scramble box for mixing the fish members used in the game.
FIG. 13 is a schematic view of a timer used in timing the game.
Figure 8:
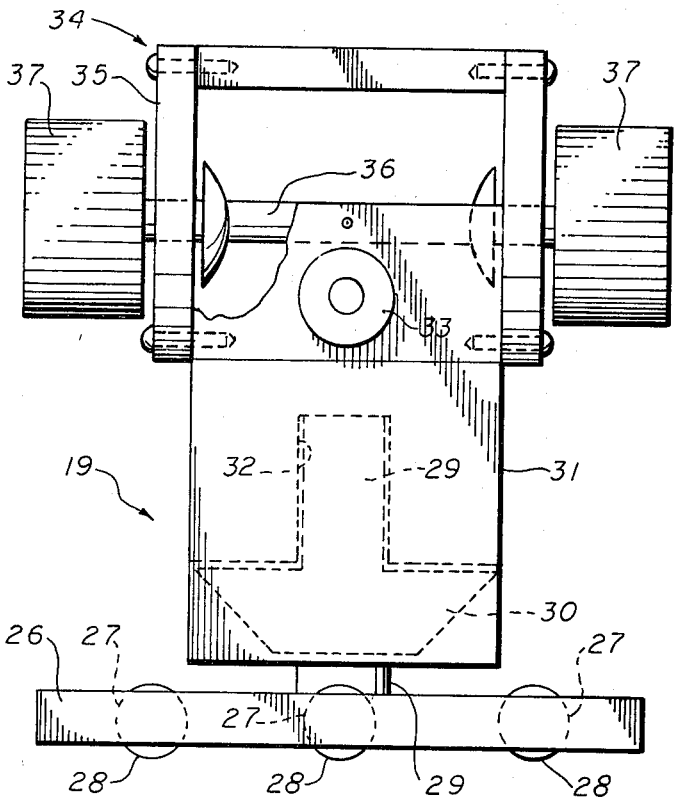
FIG. 8 is a view in left elevation of the support member and fishing pole assembly shown in FIG. 4.
Figure 9:
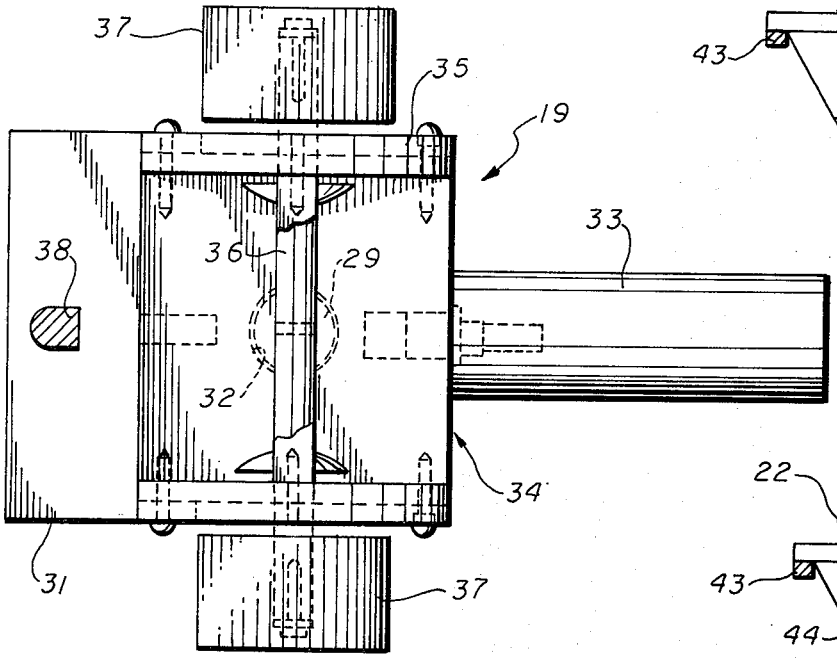
FIG. 9 is a plan view of the support member and fishing pole assembly shown in FIG. 8.

Details of Rover 19 which holds fishing rod 20 are shown in FIG. 4, 8 and 9. Rover 19 comprises a supporting base 26 having a plurality of recesses 27 in which there are supported roller balls 28 which permit sliding movement of base 26 in any direction and cavity 14. Base 26 is provided with upstanding post 29 which includes support abutment 30. Fishing pole or rod 20 is supported in supporting base 31 which has an internal recess 32 which is supported on post 29 for rotary or angular movement thereon. Supporting member 31 is provided with handle 33 extending from one side thereof and providing means for rotating support member 31 in any desired degree of angular movement and also for movement of rover base 26 in cavity 14 within the constraints of slots 17 and 18. Post 29 extends through slots 17 and/or 18 and limits the movement of rover 19 to that permitted by slots 17 and 18. Supporting base 31 also supports reel 34 which comprises spool 35 having a rotatable shaft 36 which may be turned by handles 37. Fishing pole or rod 20 fits into recess 38 on support 31 to complete the assembly. Fishing line 21 is wound or unwound from rotatable shaft 36 and is fed through hole or aperture 39 at the upper end of pole 20.

Figure 10:
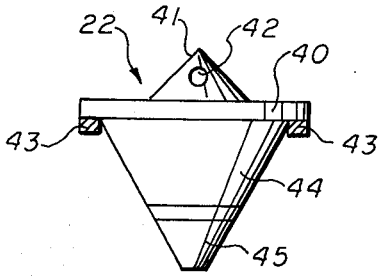
FIG. 10 is a detail view in front elevation of the magnetic retriever shown in FIG. 4.
Figure 11:
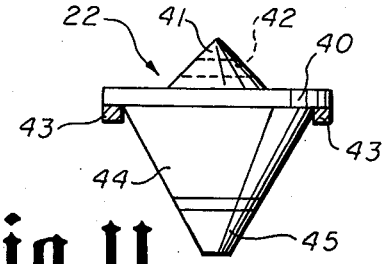
FIG. 11 is a view in left elevation of the magnetic retriever shown in FIG. 10

Cork 22 which is supported by fishing line 21 is movable vertically by winding or unwinding spool 35 by use of handles 37 to rotate shaft 36. Cork 22 is shown in more detail in FIGS. 10 and 11. Cork 22 has a disc-shaped upper support member 40 with an abutment 41 extending upward therefrom with a hole or aperture 42 therethrough for attachment of fishing line 31. Support member 40 has an annular electrical conductor member 43 secured on the bottom side thereof and adapted to make electrical contact for scoring or indicating purposes, as will be subsequently described. Cork 22 comprises a frusto-conical cork member 44 extending downward from support member 40 and which supports on its lower end a frusto-conical shaped permanent magnet 45.

Figure 2:
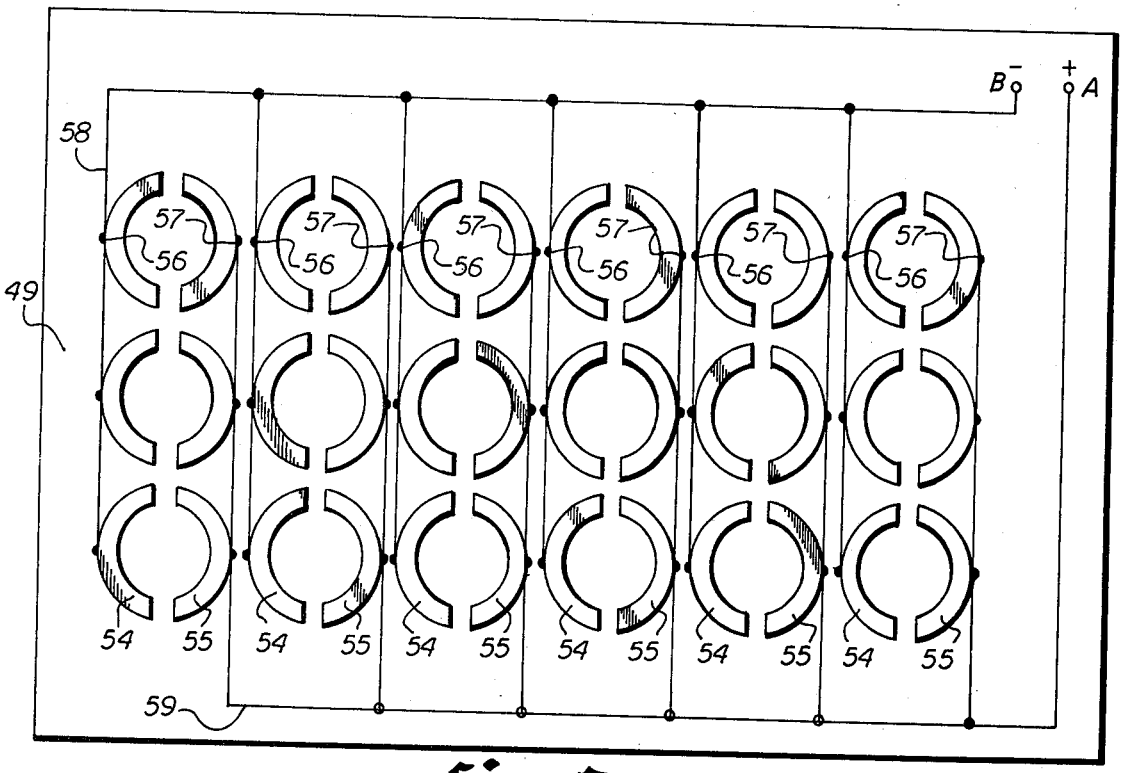
FIG. 2 is a plan view of the supporting board and circuit connections for the game shown in FIG. 1.
Figure 6:
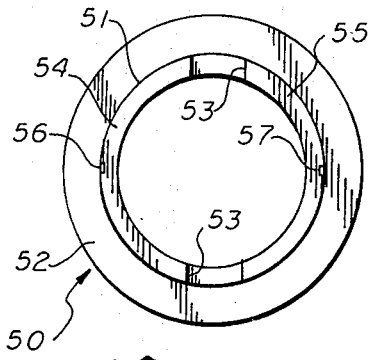
FIG. 6 is a plan view of one of the fishing receptacles shown in FIG. 4.
Figure 7:
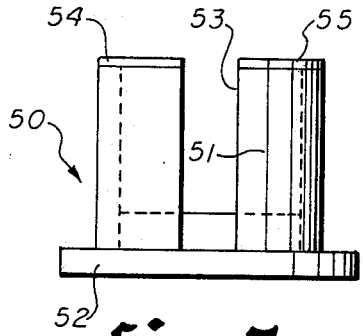
FIG. 7 is a view in side elevation of the receptacle shown in FIG. 6.

In FIG. 4, there is shown a detail view, partially in section, which shows more detail of the receptacles from which the fish 23 are recovered. In FIG. 4 it is seen that table 8 is connected to box 2 by flange 46 which extends into slot 47. Box 2 has a plurality of holes 24 in upper wall 7. There are preferably eighteen holes arranged in three rows of six. The rear end of box 2 is open as indicated at 48. A supporting panel 49 is slidable into and out of box 2 and supported on bottom wall 6. Panel 49 supports a plurality of pods or receptacles 50 which is shown in detail in FIGS. 6 and 7. Pods 50 are cylindrical receptacles 51 constructed of any suitable electrical insulating material, such as molded plastic, and have a flanged base portion 52 which is supported on panel 49. Receptacles 51 are provided with vertically extending slots 53 which divide the receptacle into two separate parts. At the upper end of receptacle 51, there are provided a pair of curved conductor plates 54 and 55 which are connected to electrical conductors 56 and 57 which extend to base flange 52 for connection in an electric circuit as shown in FIG. 2. Leads or conductors 56 are inter-connected by electrical conductors 58 to negative terminal B. Conductors 57 are likewise connected by electrical conductors 59 to positive terminal A. All of the curved conductors 54 on all eighteen of the pods or receptacles 50 are connected in parallel, as shown, to negative terminal B likewise, all of conductors 55 on pods or receptacles 50 are connected in parallel to positive terminal A. As a result, whenever electric contact is made between electric conductors 54 and 55, a circuit is completed from terminal A to terminal B.

The electric circuit supported on panel 49, shown in FIG. 2, is arranged for connection to energize signal light or Lighthouse 25 supported on top wall 7 of supporting box 2. Lighthouse 25 is constructed in a manner of an ordinary flashlight operated by dry cells 60 and 61 supported in case 62. Case 62 supports light bulb 63 at its upper end. Light bulb 63 is enclosed by clear transparent cover 64. Positive terminal of battery 60 is connected by wire or conduit 65 to positive terminal A. The negative terminal of battery 61 is connected by supporting spring 66 to case 62 which, in turn, is connected by wire 67 to negative terminal B. Terminals A and B at the end of lead wires 65 and 67 meet with terminals A and B on panel 49 in a slidable electric connection. Thus, the removal of panel 49 from the apparatus moves terminals A and B thereon out of contact with terminals A and B at the ends of leads 65 and 67. When panel 49 is in position, leads A and B are engaged with the corresponding leads on wires 65 and 67 and complete the circuit to light bulb 63, except for the gaps between electrical contact members 54 and 55 on the various pods or receptacles 50.

This fishing game will be provided with suitable ornamental design to make the same pleasing and attractive. The front of the game will have a gold crown with the name of the game, such as Pro-Fisherman, printed or written thereon. The lighthouse 25 will be of attractive design and be constructed and ornamented in a form of a lighthouse. The top panel wall 7 and all sides of box 2 will have a visual appearance or design of water and swimming fish. The top will also be ornamented with objects such as a bulkhead with boats tied up in boat stalls. The fish 23 are of a magnetic material such as iron or steel or may be of a non-magnetic material with a magnetic piece attached thereon. Fish 23 are provided in a variety of weights and are awarded points in the play of the game according to the weight of the fish and the difficulty of retrieving the same. The fish are given different colors to indicate the particular size. The relative weights are as follows: red fish 60, blue fish 50, orange fish 40, yellow fish 30, black fish 20, gold fish 15, gray fish 10, green fish 5. Three fish in each category are provided and each have a point value in the game corresponding to its relative weight. There is also provided one additional fish which has no point value and is quite light. This fish is white in color and is designated a white shark. The retrieval of the white shark represents a hazard in the play of the game and terminates the game for the particular contestant when he recovers it.

It should also be noted that the gold fish which have a relative weight and point value of 15 carries a bonus of 10 points if it is caught.

As previously noted, there are eighteen of the fish pods or receptacles 50 which are supported on removable panel board 49. Pods 50 are positioned in vertical alignment with the holes 24 in top wall 7 of box 2. Holes 24 are of sufficient size to permit the fishing cork 22 to be lowered therethrough. When cork 22 is lowered through one of the holes 24 and reaches the top of one of the pods or receptacles 50, it makes contact with electrical conductors 54 and 55 on pod 50 and electrical conductor 43 on fishing cork 22 completes the circuit therebetween to energize light bulb 63. This indicates that the cork 22 has contacted the upper surface of pod 50 which usually indicates that a fish has been caught. When cork 22 is in this position, as shown in FIG. 4, the magnet 45 is of sufficient strength to lift any of the fishes 23 that may be positioned in pod 50. The light bulb 63 is therefore turned on to indicate contact by fishing cork 22 with the upper end of pod 50 which, in turn, will indicate the capture of a fish 23 (or the white shark) if the same has not been previously removed. When the signal light is on, it is time to retract fishing line 21 by turning handles 37 and remove the captured fish 23 to proceed with the capture of more of the fish. The game is preferably provided with a suitable timer (not shown) and the objective of the game is to reach a maximum score within the specified time limit (usually 4 minutes) or before the white shark is captured and the play terminated. If desired, the bottom portion of the game which supports the same may be provided with suction cups to keep it from moving or sliding in the course of play.

The operation of the game is fairly obvious from the description of the method of construction and the function of the various parts. However, it is desirable to explain the game operation in the context of the proposed rules of play.

The objective of the game is to provide a competition between and among players to become the winner of the fishing tournament and be crowned the "Pro-Fisherman". The proposed name of the game is Pro-Fisherman. The players will play against time. The usual time of play will be four minutes although other periods of time could be established as desired. The objective of the players is to try to accumulate the most points; try to catch the biggest fish; try to catch the bonus fish; and especially to try to avoid catching the white shark. They want to catch the most fish in the time and this necessitates using their skill in catching and remembering where the fish are still located.

There are eight different types of fish with three of each type being provided and additionally one white shark. A scramble box 70, shown schematically in FIG. 12, is provided where all the fish are placed to be shaken and mixed. The game also includes a fish basket for containing the fish caught during the course of play. The fish pods 50 are numbered one through eighteen and the corresponding number is placed adjacent to the hole 24 above the pod.

Each fish will be drawn from the scramble box, one at a time, and placed in order in the fish pods 50. The fish are placed in the pods by a non-playing contestant so that the contestant fisherman will not know where the fish are being placed. The timer will be set and the fisherman will start his fishing procedure.

At the start of play, the individual players draw fish from the scramble box to determine the order of play. The player that draws the biggest fish will be the first to play and so on. In case of ties, the players will re-draw. After the first player has been selected, the procedure generally described above will be followed.

The other players will mix the fish again in the scramble box and draw out the fish one at a time and place them, in sequence, in holes numbered one through eighteen, in the fishing pods 50. The contestant fishermen will not be allowed to see where the fish are placed. The timer 71, shown schematically in FIG. 13, is wound and set on a starting position.

The contestant player or fisherman will start with his rod and reel located on the supporting table 8 with the fishing line 21 wound up and the cork 22 in an elevated position. When he is told to start, the player can move the roving support member 26 by movement of handle 33. The rover 19 may be moved as limited by slots 17 and 18. It should be noted that slots 17 and 18 do not necessarily align with the various holes and so it is necessary to pivot the rover support member 31 angularly by movement of handle 33 to align fishing line 21 and cork 22 with the hole in which cork 22 is to be dropped to retrieve one of the fish 23. It should be noted that the play will terminate at the end of the set period, e.g. four minutes, unless it is terminated earlier by the player's catching the white shark. The player will use speed and fishing instinct to get to as many of the fishing holes as he can to catch fish. At the same time, he must remember which holes have already been emptied of their fish. When the player drops fishing cork 22 through a particular hole and it reaches the top of the fishing pod 50 aligned therewith, the electrical conductor 43 completes the circuit between conductors 54 and 55 and thus causes light bulb 63 in lighthouse 25 to be illuminated. This indicates that contact has been made with the fishing pod and fishing line 21 may then be retracted to pull up the fish that has been caught. As soon as the fishing cork 22 has been pulled above the top of upper wall 7 fish 23 is removed and placed in the fish basket. The game thus continues until either the time period has elapsed or the fisherman has caught the white shark.

The player that catches the most fish that add up to the highest total points in the least amount of time will win the tournament and be crowned the Pro-Fisherman. All ties in the game will be broken by the time factor. The player that has the least amount of time will be awarded an extra ten points which could make a difference in winning the competition. After the first player has completed his round of play as a result of either the expiration of time or of his catching the white shark, the procedure will be repeated for each successive player. Of course, the fish will be reshuffled and placed at random in the fishing pods. It should be noted that the circuit panel board 49 can be removed from the apparatus to dump out the unused fish from the pods for the start of each play or at the end of the game.

Any time a player or fisherman catches all eighteen of the fish before the timer runs out or without catching the white shark, he will immediately be the winner of the tournament. While the fisherman is playing against time, the following rules apply. Any time a fish is dropped or lost on the board top or fish pods it cannot be picked up, it is a lost fish and does not score. If a player drops a fish accidentally while taking it off the cork or magnet it is a lost fish. All players must be able to remove their fish and place them in the small fish basket provided for him.

While this invention has been described fully and completely with special emphasis upon a single preferred embodiment, it should be understood that within the scope of the attended claims the invention may be practiced otherwise than as specifically described herein.

I claim:

1. A fishing game comprising
a box shaped structure having a closed top wall, said top wall having a plurality of apertures therein for selectively fishing therethrough,
a plurality of open-top, vertically-oriented cylindrical receptacles positioned one beneath each of said top wall apertures,
a plurality of fish of magnetic material and of predetermined size and weight, adapted to be positioned one in each of said receptacles to be retrieved therefrom,
electric signal means for said game,
electric power means for selectively energizing said electric signal means,
means forming a table secured to and supported on said box shaped structure extending substantially co-planar with said top wall,
means forming a track of predetermined pattern in said table,
a movable fishing pole including a manually rotatable spool with a fishing line wound thereon and supported by the end of said pole,
a movable base supported for movement in said track and including means supporting said fishing pole for movement thereon,
magnetic means supported on said fishing line for movement into and out of selected holes in said top wall into juxtaposition with preselected receptacles to pick up the magnetic fish positioned therein, and
means on said magnetic means operable upon engagement with the top of one of said receptacles to complete an electric circuit from said electric power means to said electric signal means to energize the same.

2. A fishing game according to claim 1 in which
said table comprises a hollow structure with spaced top and bottom walls,
said track comprises a plurality of slots of predetermined pattern in said top wall of said table, and
said movable base comprises a base member supported for movement between said top and bottom walls of said table and including a portion extending through one of said slots so that movement of said base is limited to the pattern of said track.

3. A fishing game according to claim 2 in which
said movable base comprises a flat base member,
a plurality of rolling ball members supported in said base member to support the same for movement in any direction in the space between said top and bottom walls of said table,
a post member supported on said base member and extending vertically through one of said slots, and
said fishing pole being supported on said post and having pivotal movement thereon.

4. A fishing game according to claim 2 in which
said track supports said base and said fishing pole in misalignment with said holes in said top wall, and
said means on said base supports said fishing pole for pivotal movement thereon to permit alignment of the end of said pole with selected ones of said holes.

5. A fishing game according to claim 4 in which
said magnetic means comprises a supporting cork and a permanent magnet supported on the lower end thereof, and
said means to complete a circuit to energize said electric signal means comprises an electric conductor supported thereon.

6. A fishing game according to claim 5 in which
said receptacles each have a pair of vertically extending slots on opposite sides thereof dividing the same into separated segments,
each of said receptacle segments having an electric conductor supported on the upper edge thereof,
electric circuit means connecting said conductors on one segment of each receptacle in parallel,
electric circuit means connecting said conductors on the other segment of each receptacle in parallel,
said first named and said second named electric circuit means being connected in series in circuit between said electric power means and said electric signal means,
said magnetic means comprises a supporting cork and a permanent magnet supported on the lower end thereof, and
an electric conductor supported on said supporting cork extending around the periphery thereof in position to engage said conductors on any one of said receptacles to complete the circuit from said electric power means to said electric signal means to energize the same.

7. A fishing game according to claim 6 in which
said movable base comprises a flat base member,
a plurality of rolling ball members supported in said base member to support the same for movement in any direction in the space between said top and bottom walls of said table,
a post member supported on said base member and extending vertically through one of said slots, and
said fishing pole being supported on said post and having pivotal movement thereon.

8. A fishing game according to claim 7 in which
said electric signal means is an electric light bulb, and
said electric power means is an electric battery.

9. A fishing game according to claim 8 in which
said fish are of a plurality of different sizes and weights and colors for scoring and include at least one fish constituting a hazard which, if caught, terminates the game.

10. A fishing game according to claim 9 including
means for mixing said fish for randomizing insertion into said receptacles.

11. A fishing game according to claim 8 including timing means for establishing the time of play.

12. A fishing game according to claim 1 in which
said track supports said base and said fishing pole in misalignment with said holes in said top wall, and
said means on said base supports said fishing pole for pivotal movement thereon to permit alignment of the end of said pole with selected ones of said holes.

13. A fishing game according to claim 1 in which
said magnetic means comprises a supporting cork and a permanent magnet supported on the lower end thereof, and
said means to complete a circuit to energize said electric signal means comprises an electric conductor supported thereon.

14. A fishing game according to claim 1 in which said receptacles each have a pair of vertically extending slots on opposite sides thereof dividing the same into separated segments, each of said receptacle segments having an electric conductor supported on the upper edge thereof, electric circuit means connecting said conductors on one segment of each receptacle in parallel, electric circuit means connecting said conductors on the other segment of each receptacle in parallel, said first named and said second named electric circuit means being connected in series in circuit between said electric power means and said electric signal means, said magnetic means comprises a supporting cork and a permanent magnet supported on the lower end thereof, and an electric conductor supported on said supporting cork extending around the periphery thereof in position to engage said conductors on any one of said receptacles to complete the circuit from said electric power means to said electric signal means to energize the same.

* * * * *